United States Patent [19]

Soonawala et al.

[11] 4,065,379

[45] Dec. 27, 1977

[54] PROCESS FOR THE PRODUCTION OF NORMALLY GASEOUS OLEFINS

[75] Inventors: Homi D. Soonawala; Steven E. den Broeder, both of The Hague, Netherlands

[73] Assignee: Shell Oil Company, Houston, Tex.

[21] Appl. No.: 648,983

[22] Filed: Jan. 14, 1976

[30] Foreign Application Priority Data

Jan. 22, 1975 United Kingdom ..... 2831/75

[51] Int. Cl.[2] ..... C07C 11/04; C10G 13/06; C10G 9/16

[52] U.S. Cl. ..... 208/67; 208/57; 208/97; 208/112; 208/143; 252/465; 260/683 R

[58] Field of Search ..... 208/67, 48 R, 57, 48 Q, 208/97; 260/683

[56] References Cited

U.S. PATENT DOCUMENTS

| | | | |
|---|---|---|---|
| 2,843,530 | 7/1958 | Langer et al. | 208/56 |
| 3,324,029 | 6/1967 | King et al. | 208/97 |
| 3,755,143 | 8/1973 | Hosoi et al. | 208/67 |
| 3,839,484 | 10/1974 | Zimmerman et al. | 260/683 R |
| 3,898,299 | 8/1975 | Jones | 260/683 R |

FOREIGN PATENT DOCUMENTS

| | | | |
|---|---|---|---|
| 1,361,671 | 7/1974 | United Kingdom | 208/61 |

*Primary Examiner*—Delbert E. Gantz
*Assistant Examiner*—G. E. Schmitkons

[57] ABSTRACT

The invention relates to an integrated process for the production of normally gaseous olefins, starting from a petroleum residue.

11 Claims, No Drawings

PROCESS FOR THE PRODUCTION OF NORMALLY GASEOUS OLEFINS

BACKGROUND OF THE INVENTION

In the petrochemical industry there is a growing demand for normally gaseous olefins, such as ethylene and propylene. In order to cope with this increasing demand, plants for the manufacture of the lower olefins have been enlarged both in number and size. Generally, most such plants subject a hydrocarbon feedstock, e.g. ethane, $C_3$–$C_5$ paraffins, naphtha or gas oil, to a thermal cracking treatment in the presence of steam. In the present description and claims, this thermal cracking treatment in the presence of steam will further be referred to as "steam-cracking"

The increase in consumption of gas oil and lower boiling fractions caused by increased olefin production may result, and in some instances has already resulted, in a shortage of suitable feedstocks for steam-cracking. Moreover, an increase in consumption of the relatively lighter tractions of the crude oil is coupled with an increased amount of heavier fractions becoming available which, unless disposed of as fuel, has to be converted in some way or another into more valuable products. Consequently, it would be advantageous if the relatively heavier fractions could be processed economically in such a manner that additional quantities of the required lower olefins are produced. In this fashion, shortages of gas oil, naphtha, and other light fractions could be minimized, while better use would be made of the heavy fractions.

In one proposed process, olefins are produced by hydrogenating a petroleum distillate containing aromatic hydrocarbons, e.g. a vacuum distillate boiling in the range of 300°–650° C, in the presence of a hydrogenation catalyst to at least partially saturate the aromatic hydrocarbons, and then steam-cracking the resulting hydrogenated product (cf. U.K. patent specification No. 1,361,671).

However, use of these feedstocks produces a bituminous residue fraction (vacuum residue) with a relatively high viscosity, which is difficult to dispose of. Additionally, in order to achieve the required saturation of the aromatic hydrocarbons, the catalytic hydrogenation of these heavier distillates has to be performed at high pressures and/or temperatures requiring the use of special hydrotreatment equipment.

Finally, the subsequent steam-cracking of the hydrotreated vacuum distillates generally results in the formation of considerable amounts of tar, with attendant fouling in furnaces and downstream equipment. Although it may be possible to obtain acceptable run lengths between subsequent decokings, in spite of the increased tendency to foul, by suitable design of furnaces and downstream equipment, significant costs would be incurred thereby at the expense of the overall economy of the process.

It has now been found that a more economic procedure can be followed, according to which a substantial part of the barrel of crude oil is converted into valuable products, while the aforesaid problems are minimized.

SUMMARY OF THE INVENTION

The invention may be described as an integrated process for the production of normally gaseous olefins, which process comprises subjecting a petroleum residue to a thermal cracking treatment, recovering by distillation from the product of the thermal cracking treatment a gas oil fraction, catalytically hydrotreating at least a substantial part of the said gas oil fraction, subjecting at least a substantial part of the hydrotreated product to a steam-cracking treatment, and recovering from the effluent thus obtained the normally gaseous olefins.

In the present description and claims, the term "normally gaseous olefins" is used for those olefins which are in the gaseous form at ambient temperatures and pressures.

The residues applied as starting material in the integrated process according to the invention are preferably atmospheric residues. Atmospheric residues typically originate from Middle-East Crudes, such as Arabian Crude or Kuwait Crude, and are generally obtained as residues by distillation of the crudes at near atmospheric pressure. Also, residues or parts thereof obtained from the atmospheric residues by distillation under reduced pressure may be used. Preferred feedstocks are residues with a cut-point above 330° C (at atmospheric pressure).

The thermal cracking treatment is performed in any suitable cracking furnace, and may be carried out in one or more stages, with or without recycle, depending on the type of residue available. The operating conditions of the furnace are selected such that severe cracking is avoided, because this is usually attended with excessive coke formation. Accordingly, rather moderate cracking temperatures are preferred, suitably lying in the range of 430° C–510° C. Operating pressures may range from 1–30 atmospheres. Coke formation may be minimized by performing the thermal cracking treatment in the presence of an inert diluent.

The thermal cracking treatment forms a versatile element of the integrated process according to the invention, and the presence of further hydrocarbon streams, in addition to the residue, can be tolerated in the feed to the cracking furnace.

The effluent from the thermal cracking unit, preferably after quenching, is transferred to a separation unit. In the separation unit, a gas oil fraction is recovered from the effluent by distillation. Usually the effluent is separated into a gas fraction, preferably mainly consisting of $C_4$ hydrocarbons and lower boiling compounds, a naphtha traction, the gas oil fraction, and a residue.

Conveniently, the gas fraction is purified and further processed. The naphtha fraction can be treated with hydrogen in the presence of a catalyst in order to convert it into an attractive feedstock for the production of additional amounts of lower olefins.

The residue, being of a relatively low viscosity as compared to the resides originating from vacuum distillation, may be disposed of as fuel.

Finally, the gas oil fraction or at least a substantial part thereof, say 90% or more, is subjected to a catalytic hydrotreatment in accordance with the process of the invention. Preferably, the feed to the catalytic hydrotreating zone is a gas oil fraction boiling in the range from 180°–370° C, but gas oils having a somewhat different boiling range, e.g. a range from 165°–370° C may be used. If desired, the gas oil feed can be combined with other streams such as straight-run gas oils, recycled steam-cracker gas oil fractions, and the like. Naphtha fractions can also be subjected to the hydrotreatment together with the gas oil fraction from the thermal cracking unit, but this embodiment requires a normally expensive built-in flexibility of the hydrotreatment equipment, and is therefore not recommended.

The catalytic hydrotreatment can be performed in any suitable manner, and various procedures known in the art can be followed with good results. Thus, the hydrotreatment may proceed in a single-stage operation or in multiple stages using the same or different catalysts. The amount of hydrogen applied should be sufficient to ensure that free gaseous hydrogen is present at the exit of the unit. It is considered most desirable that during the hydrotreatment the particular olefinic and/or acetylenic linkages which occur in the hydrocarbon participants of the gas oil feed obtained from the thermal cracking unit are saturated. For this reason, the conditions and the catalyst(s) are selected such that an optimal hydrogenation of the unsaturated linkages is effected. Recommended catalysts for this purpose include supported catalysts containing one or more metals from the Groups VIB and VIII of the Periodic Table, e.g. supported molybdenum, cobalt, molybdenum-cobalt, nickel or nickel-tungsten catalysts. Suitable supports are, for example, alumina, silica and silica-alumina. Usually, the metals are present in the form of their oxides and/or sulfides, although the metals may also partly occur in their metallic form or in chemical combination with the support. A preferred catalyst contains molybdenum and cobalt supported on alumina.

Suitable hydrotreating temperatures are in the range of 250° C to 400° C, although temperatures outside this range are not precluded. Application hydrotreating temperatures between 300° C and 390° C is preferred.

The applied pressure in the hydrotreating unit may vary considerably. However, one advantage of the process of the invention is that the hydrotreating can be performed at lower severities than are applicable to the hydrotreating of vacuum distillates. Thus, preferred pressures are in the range of 15–90 atmospheres, most preferably in the range of 20–60 atmospheres. Space velocities may vary from 0.2 to 8.0 tons of feed per hour and per $m^3$ catalyst, though the preferred range is from 0.5 to 5.0 t/h.$m^3$. The gas rate may be in excess of 40 $Nm^3$ $H_2$/ton of feed; the preferred range is 150–350 $Nm^3$/t.

The product obtained in the hydrotreating zone is conveniently cooled, followed by removal of the gaseous components of the product, mainly hydrogen. The hydrogen containing stream can be recycled to the hydrotreating zone.

The remainder, being the hydrotreated thermal cracker gas oil fraction, optionally in admixture with further material as indicated above, is transferred to a steam-cracking unit. If desired, part of the gas oil may be used for some other purpose, e.g. as blending component, but in general the fraction is completely processed in the steam cracker.

It has been observed that the suitablity of the hydrotreated gas oil originating from the thermal cracking unit as feedstock for the production of lower olefins is as good as, or better than that of straight-run gas oil fractions currently used for this purpose, and for this reason the same conditions, apparatus and equipment materials are preferred in the steam-cracking of the process according to the invention as are known in the art to be optimal for the steam-cracking of straight-run gas oils. Typical conditions for the steam-cracking are cracking temperatures in the range of 700° C–900° C, preferably in the range of 775° C–850° C, steam/hydrocarbon weight ratios between 0.4 and 2.0, preferably between 0.5 and 1.1, and residence times below 5 sec., in particular between 0.04 and 1.0 sec.

It is usually preferred to operate the steam-cracking unit under such conditions and by employing such equipment that ethylene is produced in an optimal yield. It is feasible to build in some flexibility in order to effect that the yield of some other lower olefinic product is optimized, in particular that of propylene.

The invention will further be illustrated by the following example.

EXAMPLE

A feedstock consisting of a petroleum residue, obtained by atmospheric distillation of a Middle East Crude, was introduced into a thermal cracking unit. The residue had a cut point of 370° C, a sulfide content of 2.6%w, Conradson carbon residue of 8.0%w and a kinematic viscosity at 210° F of 38.3 cS.

The thermal cracking was performed in two stages. In the first stage a conventional cracking furnace was used, equipped with a heating coil (diameter 10 cm). It was operated at an outlet temperature of 485° C and an outlet pressure of 3.5 atmospheres. The residence time (based on cold feed) in the furnace was about 4 minutes. The cracked product mixed with 3%w steam was directed to a cyclone separator where it was divided into a residue stream and a vapor stream. The latter was transferred to a fractionator. A few trays above the fractionator feed tray a side stream was withdrawn and introduced into a second cracking furnace. Here it was thermally cracked at an outlet temperature and pressure of 495° C and 20 atmospheres respectively. The residence time (based on cold feed) was about 5 minutes. The effluent was quenched to 460° C and reintroduced in the fractionator at the appropriate tray. From the fractionator a residue stream was removed which was combined with the residue stream from the cyclone separator.

From the fractionator 4% of fuel gas was recovered, comprising $C_1$–$C_4$ hydrocarbons, $H_2S$ and some hydrogen, 9% of a naphtha fraction with a boiling range (ASTM, 10–90%v) of 59°–146° C, an average molecular weight of 97, a sulfur content of about 1%w and a hydrogen/carbon atomic ratio of 2.04, and 24% of a gas oil fraction with a boiling range (ASTM, 10–90%v) of 195°–316° C, an average molecular weight of 186, a sulfur content of 1.5%w and a hydrogen/carbon atomic ratio of 1.89. The combined residue stream (63%) had a kinematic viscosity at 210° F of 170 cS and a sulfur content of 3.1%w. The percentages of the various fractions are weight percentages on intake.

The naphtha fraction was hydrotreated with the aid of a cobaltmolybdenum catalyst and subsequently steam-cracked. The obtained products and yields (in %w on intake) were: hydrogen (0.8), methane (12.2), ethylene (25.1), other $C_2$ (4.1), propylene (16.7), other $C_3$ (0.8), butadiene (4.5), other $C_4$ (6.3), pyrolysis gasoline ($C_5$ — 200° C) (25.1), cracker gas oil (200°–315° C) (3.9) and pitch (>315° C) (0.5).

The gas oil fraction was introduced into a hydrotreater loaded with an alumina supported Co/Mo catalyst. This catalyst (1.5 mm extrudates) comprised 4% Co and 10% Mo (as oxides) and had a surface area of 282 $m^2$/g and a pore volume of 0.46 ml/g. It was presulfided.

The applied hydrotreating conditions and the properties of the hydrotreated gas oil are given in the Table under A.

The effluent from the hydrotreater was cooled, the gaseous fraction, consisting mainly of hydrogen, was separated and recycled to the hydrotreater, while the liquid fraction (hydrotreated gas oil) was introduced as feed into a steam-cracking unit, which comprised a preheating zone and a cracking zone, equipped with a cracking coil of 7 m length and with an internal diameter of 0.01 m. The feed, after admixture with steam, was preheated and subsequently steam-cracked. The conditions employed in the steam-cracking zone and the obtained product yields are given in the Table under A.

For further comparison a straight-run gas oil was steam-cracked. In the Table the properties of this gas oil, the conditions applied in the thermal cracking unit, and the obtained furnace product yields are given under D.

In the Table the percentages of hydrogen in the $C_5$ and heavier fractions of the furnace effluents are also listed, a higher hydrogen percentage being indicative of a diminished tendency to coke.

TABLE

| | A | B | C | D |
|---|---|---|---|---|
| Hydrotreatment conditions | | | | |
| Catalyst | Co-Mo | Co-Mo | Ni-Mo-F | |
| Space velocity (t feed/ h/m$^3$ cat.) | 1.0 | 0.9 | 0.9 | |
| Temperature (° C) (average) | 359 | 353 | 354 | |
| Pressure (ata) | 25 | 50 | 130 | |
| Gas rate (Nm$^3$ $H_2$/t feed) | 350 | 500 | 1000 | |
| Hydrogen uptake (increase in hydrogen/carbon atomic ratio) | 0.150 | 0.130 | 0.186 | |
| Properties of hydrotreated product (feed to steam cracking unit) | | | | |
| Boiling range (10%v-90%v)(° C) | 191-319 (ASTM) | 305-505 (UOP) | 308-502 (UOP) | 308-341 (UOP) |
| Molecular weight | 186 | 367 | 358 | 268 |
| Hydrogen/carbon atomic ratio | 2.04 | 1.83 | 1.886 | 1.89 |
| n-Paraffins (%w) | 19.7 | 8.5 | 8.1 | 19.1 |
| Aromatics (%w) | 17.9 | 29.3 | 20.3 | 20.6 |
| Steam cracking conditions | | | | |
| Steam/hydrocarbon ratio(w/w) | 1.0 | 0.94 | 1.04 | 1.03 |
| Outlet temperature (° C) | 790 | 790 | 790 | 790 |
| Residence time (sec.) | 0.33 | 0.32 | 0.31 | 0.29 |
| Steam cracking effluent(products and yields in %w on intake) | | | | |
| Hydrogen | 0.6 | 0.6 | 0.6 | 0.5 |
| Methane | 10.0 | 11.1 | 10.6 | 8.1 |
| Ethylene | 23.5 | 22.6 | 22.9 | 20.5 |
| Other $C_2$ | 3.6 | 3.7 | 3.4 | 3.1 |
| Propylene | 15.5 | 13.4 | 13.4 | 14.5 |
| Other $C_3$ | 0.8 | 0.9 | 0.9 | 0.8 |
| Butadiene | 4.5 | 4.5 | 4.5 | 4.4 |
| Other $C_4$ | 6.3 | 4.1 | 4.3 | 6.7 |
| Pyrolysis gasoline($C_5$ - 200° C) | 19.5 | 13.2 | 20.3 | 17.6 |
| Cracker gas oil (200-315° C) | 14.2 | 17.2 | 14.2 | 17.6 |
| Pitch (> 315° C) | 1.5 | 8.7 | 4.9 | 6.2 |
| % Hydrogen in $C_5$ and heavier fractions | 9.96 | 6.85 | 7.85 | 9.23 |

For comparison, two experiments were carried out starting with a vacuum distillate. The vacuum distillate had a boiling range (UOP, 10-90%v) of 336°-520° C, an average molecular weight of 381, a hydrogen/carbon atomic ratio of 1.7, a sulfur content of 2.78%w and a aromatic content of 42.1%w.

A portion of the said vacuum distillate was hydrotreated under mild conditions, using the cobalt-molybdenum catalyst, as hereinbefore described. Another portion was hydrotreated under more severe conditions, using a Ni-Mo-F catalyst. This catalyst comprised: 3% Ni, 12% Mo (as oxides) and 6% F on alumina and had a surface area of 151 m$^2$/g and a pore volume of 0.29 ml/g.

The conditions applied in the mild and severe hydrotreating as well as the properties of the obtained product, are included in the Table under B and C, respectively.

By comparing the results indicated under B and A it becomes evident that in the former case (B), notwithstanding the higher pressure applied, hydrogen uptake is lower, thus indicating the difficulty in hydrogenating the vacuum distillate.

The two hydrotreated products were subsequently subjected to steam-cracking treatments. The applied conditions and the furnace yields are likewise given in the Table under B and C.

What we claim is:

1. A process for the production of normally gaseous olefins from a petroleum residue, which comprises subjecting the petroleum residue to a thermal cracking treatment, recovering a gas oil fraction by distillation from the product of the thermal cracking treatment, catalytically hydrotreating at least a substantial part of the gas oil fraction, steam-cracking at least a substantial part of the hydrotreated product and recovering normally gaseous olefins from the effluent thus obtained.

2. The process of claim 1, in which the starting material is an atmospheric petroleum residue with a cut-point above 330° C.

3. The process of claim 2 in which the residue is subjected to a thermal cracking treatment at a temperature between 430° and 510° C.

4. The process of claim 3 in which the thermal cracking treatment of the residue is followed by quenching the product obtained.

5. The process of claim 4 in which a $C_4$- gas fraction, a naphtha fraction and a gas oil fraction are recovered by distillation from the product of the thermal cracking step.

6. The process of claim 5, in which a gas oil fraction boiling in the range from 180° C-370° C is recovered.

7. The process of claim 6, in which at least a substantial part of the gas oil fraction is subjected to a hydrotreatment in the presence of an alumina supported catalyst containing cobalt and molybdenum.

8. The process of claim 7, in which the catalytic hydrotreatment is performed at a temperature between 300° and 390° C and a pressure between 20 and 60 atmospheres.

9. The process of claim 8, in which the hydrotreated product is subjected to a steam-cracking treatment in a steam/hydrocarbon weight ratio between 0.5 and 1.1

10. The process of claim 9 in which the steam-cracking treatment is performed at a temperature between 775° C and 850° C and a residence time between 0.04 and 1.0 sec.

11. The process of claim 10, in which ethylene is recovered from the product obtained in the steam-cracking step.

* * * * *